US011169468B2

(12) United States Patent
Miura et al.

(10) Patent No.: US 11,169,468 B2
(45) Date of Patent: Nov. 9, 2021

(54) IMAGE FORMING APPARATUS AND COLLECTING DEVICE

(71) Applicant: FUJIFILM Business Innovation Corp., Tokyo (JP)

(72) Inventors: Go Miura, Kanagawa (JP); Seigo Shinozaki, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/005,966

(22) Filed: Aug. 28, 2020

(65) Prior Publication Data

US 2021/0302876 A1 Sep. 30, 2021

(30) Foreign Application Priority Data

Mar. 27, 2020 (JP) ..... JP2020-057128

(51) Int. Cl.
*G03G 15/00* (2006.01)
*G03G 15/095* (2006.01)
*G03G 15/01* (2006.01)

(52) U.S. Cl.
CPC ..... *G03G 15/095* (2013.01); *G03G 15/0121* (2013.01)

(58) Field of Classification Search
CPC ..... G03G 15/095; G03G 15/0121
See application file for complete search history.

(56) References Cited

U.S. PATENT DOCUMENTS

2008/0063421 A1* 3/2008 Tamaki ..... G03G 21/10 399/74
2010/0061742 A1* 3/2010 Kim ..... G03G 15/0121 399/27
2010/0080637 A1* 4/2010 Yamaguchi ..... G03G 21/10 399/358
2012/0275804 A1* 11/2012 Watanabe ..... G03G 15/0189 399/39
2013/0183050 A1* 7/2013 Kwon ..... G03G 21/12 399/35
2014/0161474 A1* 6/2014 Oda ..... G03G 21/105 399/35
2015/0227107 A1* 8/2015 Ishizuka ..... G03G 15/0178 399/44

FOREIGN PATENT DOCUMENTS

CN 2816858 Y * 9/2006 ..... G03G 21/0064
JP 2001-331007 A 11/2001
JP 2002-132112 A 5/2002

* cited by examiner

*Primary Examiner* — Francis C Gray
(74) *Attorney, Agent, or Firm* — Sughrue Mion, PLLC

(57) ABSTRACT

An image forming apparatus includes a black image carrier that holds toner images of black, a yellow image carrier that holds toner images of yellow, a magenta image carrier that holds toner images of magenta, a cyan image carrier that holds toner images of cyan, at least one spot-color image carrier, and multiple collecting units. The at least one spot-color image carrier holds toner images of a spot color other than black, yellow, magenta, and cyan. Each of the collecting units collects waste toner. The collecting units include a first collecting unit that collects waste toner removed from the black image carrier, and waste toner removed from the spot-color image carrier.

22 Claims, 7 Drawing Sheets

IMAGE FORMING APPARATUS AND COLLECTING DEVICE

CROSS-REFERENCE TO RELATED APPLICATIONS

This application is based on and claims priority under 35 USC 119 from Japanese Patent Application No. 2020-057128 filed Mar. 27, 2020.

BACKGROUND

(i) Technical Field

The present disclosure relates to an image forming apparatus and a collecting device.

(ii) Related Art

Japanese Unexamined Patent Application Publication No. 2002-132112 discloses an image forming apparatus including a photoconductor cleaning device that collects waste toner from a photoconductor, and an intermediate-transfer-body cleaning device that collects waste toner from an intermediate transfer body.

Japanese Unexamined Patent Application Publication No. 2001-331007 discloses an image forming apparatus that includes a cleaning device that collects waste toner from a photoconductor belt. The cleaning device of the image forming apparatus includes a black-waste-toner bottle for collecting black waste toner and a non-specific-color-waste-toner bottle for collecting non-specific-color waste toner.

SUMMARY

When an image forming apparatus collects waste toner removed from, for example, image carriers by cleaning units with multiple collecting units, the amount of waste toner collected by the respective collecting units may vary between the collecting units.

Aspects of non-limiting embodiments of the present disclosure relate to collection of waste toner with multiple collecting units while the amount of waste toner collected by respective collecting units is prevented from varying between the collecting units.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus that includes a black image carrier that holds toner images of black, a yellow image carrier that holds toner images of yellow, a magenta image carrier that holds toner images of magenta, a cyan image carrier that holds toner images of cyan, at least one spot-color image carrier, and multiple collecting units. The at least one spot-color image carrier holds toner images of a spot color other than black, yellow, magenta, and cyan. Each of the collecting units collects waste toner. The collecting units include a first collecting unit that collects waste toner removed from the black image carrier, and waste toner removed from the spot-color image carrier.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the attached drawings.

First Exemplary Embodiment

Figure 1:
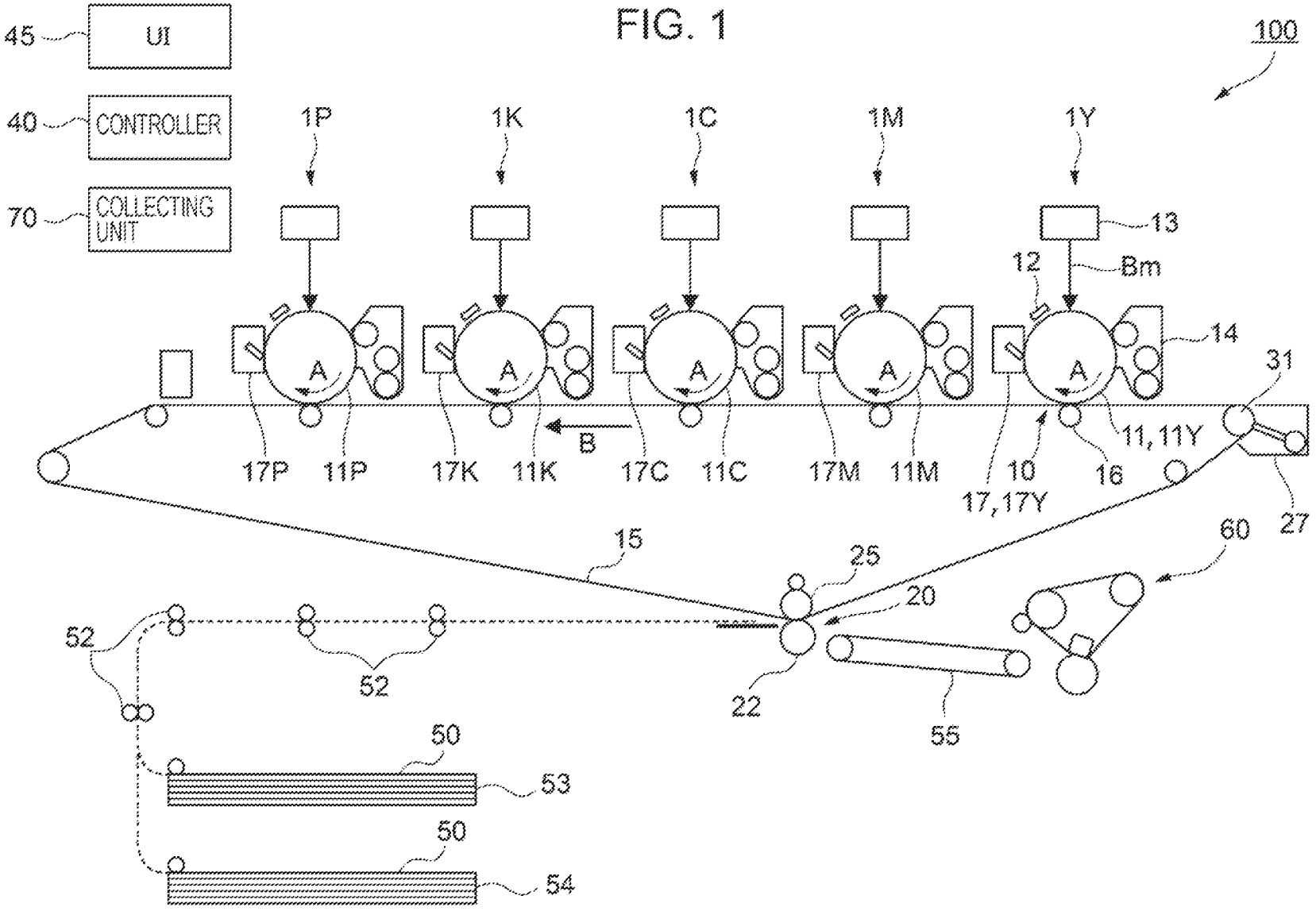
FIG. 1 is a schematic diagram of a structure of an image forming apparatus according to an exemplary embodiment.

FIG. 1 is a schematic diagram of a structure of an image forming apparatus 100 according to an exemplary embodiment.

The image forming apparatus 100 in FIG. 1 is an intermediate-transfer image forming apparatus, generally called a tandem image forming apparatus. The image forming apparatus 100 includes multiple image forming units 1Y, 1M, 1C, 1K, and 1P, which form toner images of respective colors by electrophotography.

The image forming units 1Y, 1M, 1C, and 1K respectively form images of yellow (Y), magenta (M), cyan (C), and black (K) (these colors may be also referred to as ordinary colors, below). The image forming unit 1P forms images of a spot color different from the ordinary colors. Here, the spot color is a color different from the ordinary colors, for example, a color that is not easily generated from toner of ordinary colors, that is, yellow, magenta, cyan, and black. Specific examples of the spot color include white, transparent, light cyan, light magenta, orange, violet, green, fluorescent pink, fluorescent yellow, and metallic colors such as gold or silver formed from metallic pigments. Examples are not limited to these examples.

The image forming apparatus 100 includes first transfer portions 10, which sequentially first-transfer different-color toner images formed by the respective image forming units 1Y, 1M, 1C, 1K, and 1P to an intermediate transfer belt 15. The image forming apparatus 100 also includes a second transfer portion 20, which collectively second-transfers a superposed toner image transferred to the intermediate transfer belt 15 to a sheet 50.

The image forming apparatus 100 also includes a fixing device 60, which fixes the second-transferred toner image to the sheet 50. The image forming apparatus 100 also includes a controller 40, formed from a CPU controlled by a program, to control each component in the image forming apparatus 100. The image forming apparatus 100 also includes a user interface (UI) 45, which is formed from, for example, a display panel to receive information from a user and provide information to a user.

The image forming units 1Y, 1M, 1C, 1K, and 1P, functioning as part of an image forming portion, include the following electrophotographic devices. First, each of the image forming units 1Y, 1M, 1C, 1K, and 1P includes a photoconductor drum 11, which rotates in the direction of arrow A, and a charging device 12, which is disposed around the photoconductor drum 11 to electrically charge the photoconductor drum 11. Each of the image forming units 1Y, 1M, 1C, 1K, and 1P includes a laser exposure device 13, which writes electrostatic latent images on the photoconductor drum 11. An exposure beam emitted from each laser exposure device 13 is denoted with Bm in FIG. 1. In the following description, the photoconductor drums 11 of the respective image forming units 1Y, 1M, 1C, 1K, and 1P may be referred to as photoconductor drums 11Y, 11M, 11C, 11K, and 11P. The photoconductor drum 11Y is an example of a yellow image carrier, the photoconductor drum 11M is an example of a magenta image carrier, the photoconductor drum 11C is an example of a cyan image carrier, the photoconductor drum 11K is an example of a black image carrier, and the photoconductor drum 11P is an example of a spot-color image carrier.

Each of the image forming units 1Y, 1M, 1C, 1K, and 1P also includes a developing device 14, which accommodates a developer containing a carrier and toner and forms an electrostatic latent image on the photoconductor drum 11 into a visible image with toner. Each of the image forming units 1Y, 1M, 1C, 1K, and 1P also includes first transfer roller 16, which transfers toner images of the corresponding color formed on the photoconductor drum 11 to the intermediate transfer belt 15 at a first transfer portion 10. Each of the image forming units 1Y, 1M, 1C, 1K, and 1P also includes a drum cleaner 17, which removes toner remaining on the photoconductor drum 11. The drum cleaner 17 is formed from, for example, a cleaning blade that comes into contact with the surface of the photoconductor drum 11 to scrape off the toner remaining on the surface of the photoconductor drum 11. In the following description, the drum cleaners 17 of the image forming units 1Y, 1M, 1C, 1K, and 1P may also be referred to as drum cleaners 17Y, 17M, 17C, 17K, and 17P.

The intermediate transfer belt 15 is circularly moved by a driving roller 31, driven by a motor not illustrated, at a predetermined speed in the direction of arrow B in FIG. 1. The first transfer portion 10 includes the first transfer rollers 16 opposing the intermediate transfer belt 15. Toner images on the respective photoconductor drums 11 are sequentially electrostatically attracted to the intermediate transfer belt 15 to form a superposed toner image on the intermediate transfer belt 15.

The second transfer portion 20 includes a second transfer roller 22 disposed facing a toner-image-carrying surface of the intermediate transfer belt 15, and a back-up roller 25. The second transfer roller 22 is disposed to press the back-up roller 25 while holding the intermediate transfer belt 15 therebetween. The second transfer roller 22 is grounded. A second transfer bias is formed between the second transfer roller 22 and the back-up roller 25. The toner image is second-transferred to the sheet 50 transported to the second transfer portion 20. A belt cleaner 27, which removes toner remaining on the intermediate transfer belt 15, is disposed. The belt cleaner 27 is formed from, for example, a cleaning blade that comes into contact with the surface of the intermediate transfer belt 15 to scrape off toner remaining on the surface of the intermediate transfer belt 15.

The image forming apparatus 100 also includes a collecting unit 70. The collecting unit 70 collects waste toner removed from the photoconductor drums 11 of the image forming units 1Y, 1M, 1C, 1K, and 1P by the drum cleaners 17Y, 17M, 17C, 17K, and 17P, and waste toner removed from the intermediate transfer belt 15 by the belt cleaner 27. The structure of the collecting unit 70 will be described later in detail.

Basic image forming processing of the image forming apparatus 100 will be described.

The image forming apparatus 100 outputs image data from, for example, an image reading device, not illustrated. This image data undergoes image processing with an image processing device, not illustrated, is converted into Y, M, C, and K four color tone data, and is then output to the laser exposure device 13.

The laser exposure device 13 radiates the exposure beams Bm from, for example, a semiconductor laser to the photoconductor drum 11 of the corresponding one of the image forming units 1Y, 1M, 1C, and 1K in accordance with the input color tone data. After the surface of each photoconductor drum 11 is electrically charged by the charging device 12, the surface is exposed to light to be scanned by the laser exposure device 13 to have an electrostatic latent image formed thereon. After a toner image is formed on the photoconductor drum 11 by the developing device 14, the toner image is transferred to the intermediate transfer belt 15 at the first transfer portion 10 where the photoconductor drum 11 and the intermediate transfer belt 15 come into contact with each other.

After the toner image is first-transferred to the surface of the intermediate transfer belt 15, the toner image is transported to the second transfer portion 20 with movement of the intermediate transfer belt 15. In the second transfer portion 20, the second transfer roller 22 is pressed against the back-up roller 25 with the intermediate transfer belt 15 interposed in between. Here, a sheet 50 transported thereto from a first sheet container 53 or a second sheet container 54 by transport rollers 52 or other rollers is held between the intermediate transfer belt 15 and the second transfer roller 22.

The second transfer portion 20 collectively electrostatically transfers an unfixed toner image held on the intermediate transfer belt 15 to the sheet 50. Thereafter, the sheet 50 to which the toner image is electrostatically transferred is separated from the intermediate transfer belt 15, and then transported to a transport belt 55, disposed downstream of the second transfer roller 22 in a sheet transport direction. The transport belt 55 transports the sheet 50 to the fixing device 60.

The toner image on the sheet 50 transported to the fixing device 60 receives heat and pressure from the fixing device 60 to be fixed onto the sheet 50. The sheet 50 to which the image is fixed is discharged from the image forming apparatus 100.

The toner adhering to the photoconductor drums 11 after first transfer is removed by the drum cleaners 17, and the toner adhering to the intermediate transfer belt 15 after second transfer is removed by the belt cleaner 27. Toner (waste toner) removed by the drum cleaners 17 and the belt cleaner 27 is collected by the collecting unit 70.

Thus, the image forming apparatus 100 repeats image formation processing by the number of cycles corresponding to the number of prints.

Figure 2:
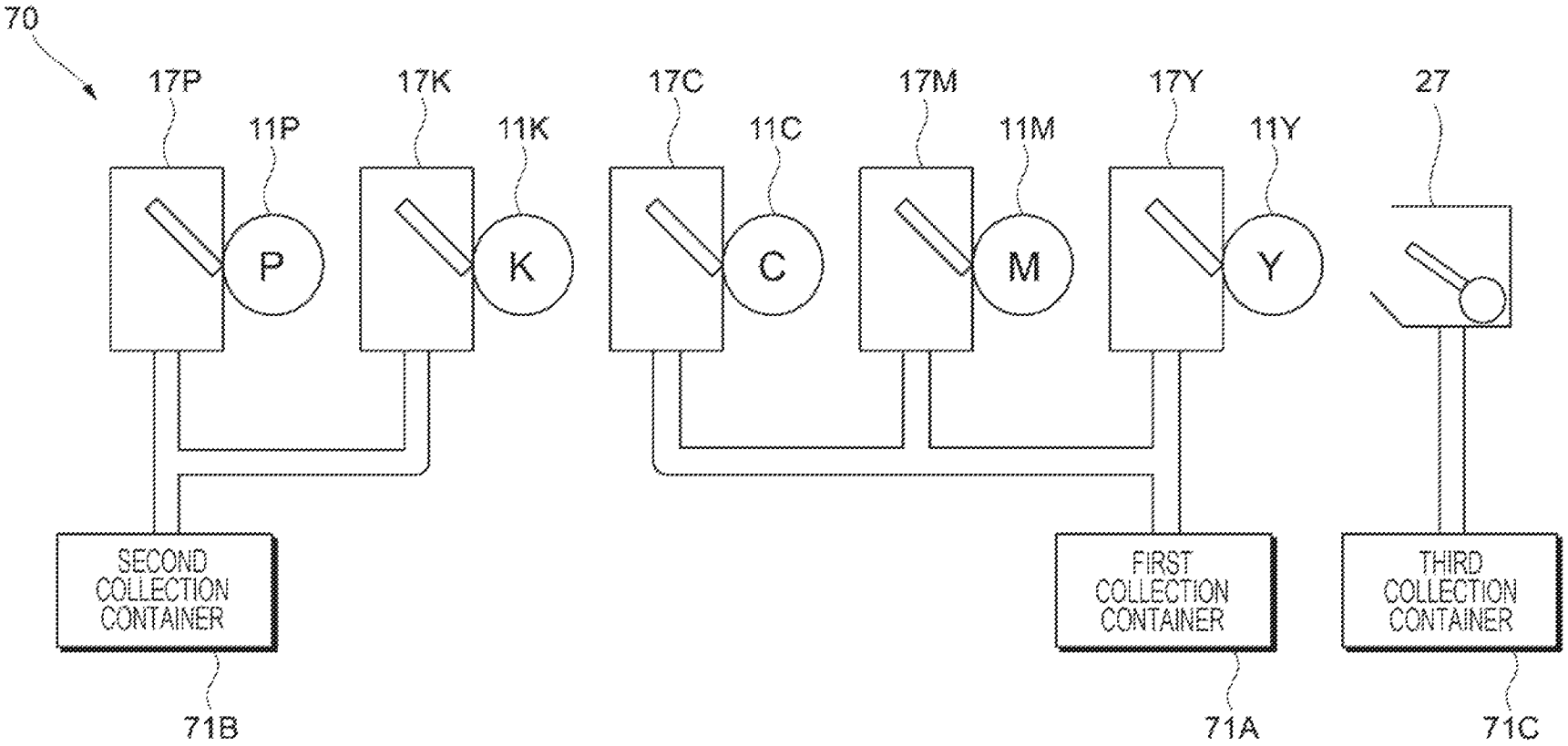
FIG. 2 illustrates a structure of a collecting unit according to a first exemplary embodiment.

Subsequently, the collecting unit 70 according to the present exemplary embodiment will be described. FIG. 2 illustrates a structure of the collecting unit 70 according to the first exemplary embodiment.

The collecting unit 70 according to the present exemplary embodiment includes multiple collection containers each collecting waste toner. In this example, the collecting unit 70 includes a first collection container 71A, a second collection container 71B, and a third collection container 71C, each of which collects waste toner. The first collection container 71A, the second collection container 71B, and the third collection container 71C have the same structure and the same capacity. Here, the first collection container 71A is an example of a second collecting unit, the second collection container 71B is an example of a first collecting unit, and the third collection container 71C is an example of a third collecting unit.

Each of the collection containers (the first collection container 71A, the second collection container 71B, and the third collection container 71C) of the collecting unit 70 includes a sensor, not illustrated, that detects an excess of the collected waste toner amount over a predetermined reference amount. Based on the detection results of each sensor, a user of the image forming apparatus 100 removes the corresponding collection container from the image forming apparatus 100 to replace the collection container with a new collection container.

In the present exemplary embodiment, the collecting unit 70 collects waste toner with the multiple collection containers (the first collection container 71A, the second collection container 71B, and the third collection container 71C). This structure enables reduction of the capacity of each collection container, compared to the structure where waste toner is collected with one collection container. Thus, the image forming apparatus 100 is designed more freely.

From the view point of reducing frequency of replacing collection containers, preferably, in the image forming apparatus 100, the amount of waste toner collected with the multiple collection containers varies less between the multiple collection containers (the first collection container 71A, the second collection container 71B, and the third collection container 71C). The collecting unit 70 according to the present exemplary embodiment has the structure described below to reduce the difference between the amounts of waste toner collected with the multiple collection containers (the first collection container 71A, the second collection container 71B, and the third collection container 71C).

As illustrated in FIG. 2, in the collecting unit 70 according to the present exemplary embodiment, the first collection container 71A collects yellow waste toner removed from the surface of the photoconductor drum 11Y by the drum cleaner 17Y, magenta waste toner removed from the surface of the photoconductor drum 11M by the drum cleaner 17M, and cyan waste toner removed from the surface of the photoconductor drum 11C by the drum cleaner 17C.

The second collection container 71B collects black waste toner removed from the surface of the photoconductor drum 11K by the drum cleaner 17K and spot-color waste toner removed from the surface of the photoconductor drum 11P by the drum cleaner 17P.

The third collection container 71C collects waste toner removed from the surface of the intermediate transfer belt 15 by the belt cleaner 27.

In the image forming apparatus 100, the image forming units 1Y, 1M, 1C, 1K, and 1P differ from each other in toner consumption. Thus, the amount of waste toner left on the surfaces of the photoconductor drums 11Y, 11M, 11C, 11K, and 11P of the image forming units 1Y, 1M, 1C, 1K, and 1P and removed by the drum cleaners 17Y, 17M, 17C, 17K, and 17P differ between each other.

For example, among the image forming units 1Y, 1M, 1C, 1K, and 1P, toner of ordinary colors (yellow, magenta, cyan, and black) is highly likely to be consumed more than toner of spot colors. Thus, the amount of waste toner removed from each of the surfaces of the ordinary-color photoconductor drums 11Y, 11M, 11C, and 11K by the ordinary-color drum cleaners 17Y, 17M, 17C, and 17K is larger than the amount of waste toner removed from the surface of the spot-color photoconductor drum 11P by the spot-color drum cleaner 17P.

Among the ordinary-color image forming units 1Y, 1M, 1C, and 1K, the toner consumption of black is larger than the toner consumption of yellow, magenta, and cyan. Thus, the amount of waste toner removed from the surface of the black photoconductor drum 11K by the black drum cleaner 17K is larger than the amount of waste toner removed from each of the surfaces of the photoconductor drums 11Y, 11M, and 11C by the drum cleaners 17Y, 17M, and 17C.

Specifically, the relationship between the photoconductor drums 11Y, 11M, 11C, 11K, and 11P in terms of amount of waste toner removed from the photoconductor drums 11Y, 11M, 11C, 11K, and 11P by the drum cleaners 17Y, 17M, 17C, 17K, and 17P of the image forming units 1Y, 1M, 1C, 1K, and 1P satisfies the photoconductor drum 11K>the photoconductor drums 11Y, 11M, and 11C>the photoconductor drum 11P.

In the collecting unit 70 according to the present exemplary embodiment, a large amount of black waste toner removed from the photoconductor drum 11K by the drum cleaner 17K and a small amount of spot-color waste toner removed from the photoconductor drum 11P by the drum cleaner 17P are collected with the same collection container (second collection container 71B). Compared to the case where, for example, the black waste toner is collected with the first collection container 71A different from a collection container that collects spot-color waste toner, this structure prevents a collection container that collects black waste toner from collecting an extremely larger amount of waste toner than other collection containers, or a collection container that collects spot-color waste toner from collecting an extremely smaller amount of waste toner than other collection containers. Thus, among multiple collection containers, the difference between the amount of waste toner collected with the first collection container 71A and the amount of waste toner collected with the second collection container 71B is reduced.

Toner adheres to the surface of the intermediate transfer belt 15 (refer to FIG. 1) from the photoconductor drums 11Y, 11M, 11C, 11K, and 11P. Thus, the belt cleaner 27 removes waste toner of multiple colors from the surface of the intermediate transfer belt 15. Thus, the belt cleaner 27 is more likely to remove a large amount of waste toner.

In the collecting unit 70 according to the present exemplary embodiment, the waste toner removed from the intermediate transfer belt 15 by the belt cleaner 27 is collected with the third collection container 71C, different from the second collection container 71B that collects black waste toner removed from the photoconductor drum 11K by the drum cleaner 17K. Thus, compared to the case, for example, where waste toner removed from the intermediate transfer belt 15 by the belt cleaner 27 is collected with the second collection container 71B, which also collects black waste toner, this structure prevents an excess of the amount of waste toner collected with the second collection container 71B.

Second Exemplary Embodiment

Subsequently, a second exemplary embodiment of the present disclosure will be described. Components the same as those of the first exemplary embodiment are denoted with the same reference signs without being described in detail.

Figure 3:
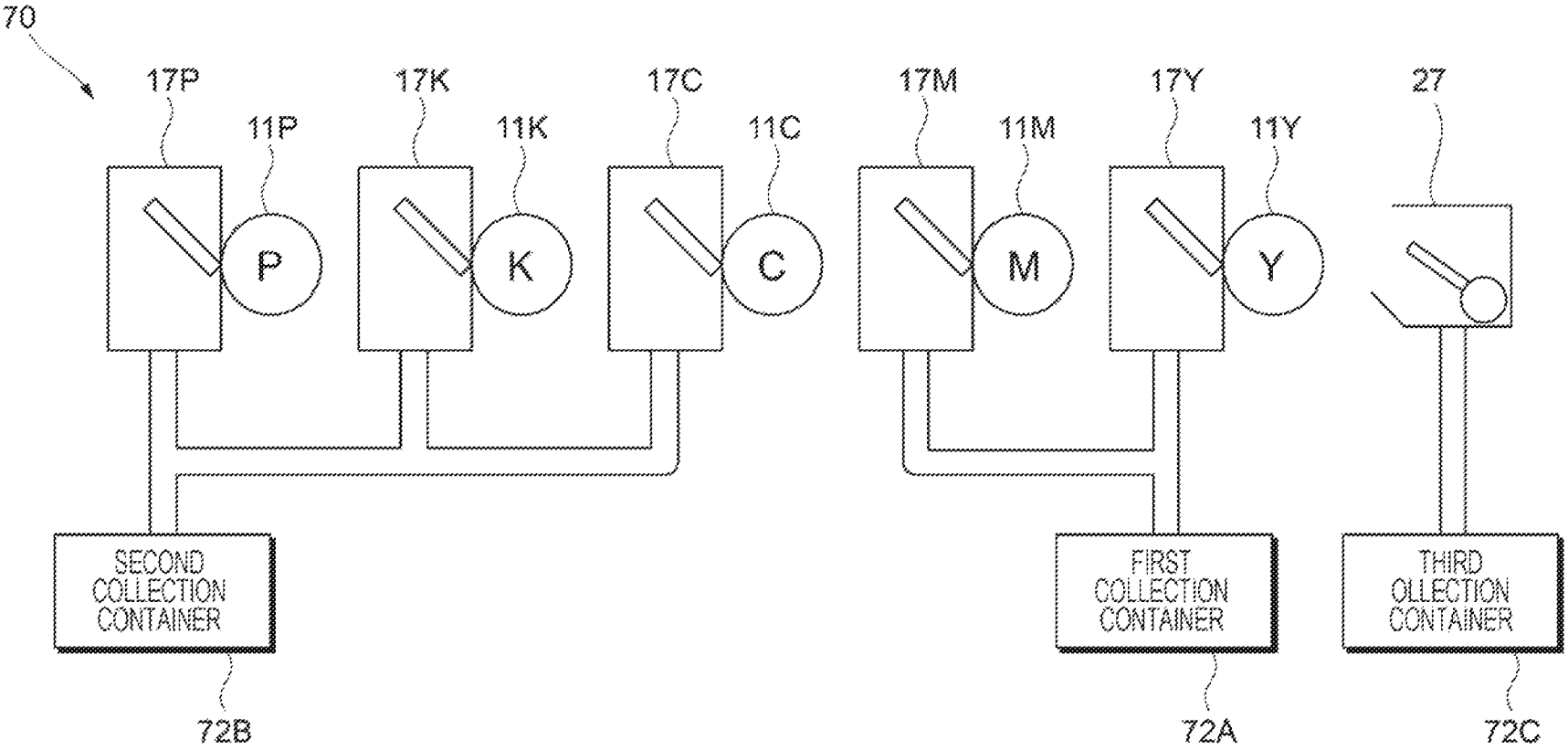
FIG. 3 illustrates a structure of a collecting unit according to a second exemplary embodiment.

FIG. 3 illustrates a structure of a collecting unit 70 according to a second exemplary embodiment.

The collecting unit 70 according to the present exemplary embodiment includes a first collection container 72A, a second collection container 72B, and a third collection container 72C, each of which collects waste toner. Here, the first collection container 72A is an example of a second collecting unit, the second collection container 72B is an example of a first collecting unit, and the third collection container 72C is an example of a third collecting unit.

As illustrated in FIG. 3, in the collecting unit 70 according to the present exemplary embodiment, the first collection container 72A collects yellow waste toner removed from the surface of the photoconductor drum 11Y by the drum cleaner 17Y, and magenta waste toner removed from the surface of the photoconductor drum 11M by the drum cleaner 17M.

The second collection container 72B collects cyan waste toner removed from the surface of the photoconductor drum 11C by the drum cleaner 17C, black waste toner removed from the surface of the photoconductor drum 11K by the drum cleaner 17K, and spot-color waste toner removed from the surface of the photoconductor drum 11P by the drum cleaner 17P.

The third collection container 72C collects waste toner removed from the surface of the intermediate transfer belt 15 by the belt cleaner 27.

In the collecting unit 70 according to the present exemplary embodiment, as in the case of the first exemplary embodiment, a large amount of black waste toner removed from the photoconductor drum 11K by the drum cleaner 17K and a small amount of spot-color waste toner removed from the photoconductor drum 11P by the drum cleaner 17P are collected with the same collection container (second collection container 72B). Compared to the case where, for example, the black waste toner is collected with the first collection container 72A different from a collection container that collects spot-color waste toner, this structure prevents a collection container that collects black waste toner from collecting an extremely larger amount of waste toner than other collection containers, or a collection container that collects spot-color waste toner from collecting an extremely smaller amount of waste toner than other collection containers. Thus, among multiple collection containers, the difference between the amount of waste toner collected with the first collection container 72A and the amount of waste toner collected with the second collection container 72B is reduced.

In addition, in the collecting unit 70 according to the present exemplary embodiment, as in the case of the first exemplary embodiment, waste toner removed from the intermediate transfer belt 15 (refer to FIG. 1) by the belt cleaner 27 is collected with a third collection container 72C, which is different from the second collection container 72B that collects black waste toner removed from the photoconductor drum 11K by the drum cleaner 17K. Thus, compared to the case where, for example, waste toner removed from the intermediate transfer belt 15 by the belt cleaner 27 is collected with the second collection container 72B, which also collects black waste toner, this structure prevents an excess of the amount of waste toner collected with the second collection container 72B.

In the collecting unit 70 according to the present exemplary embodiment, yellow waste toner removed from the photoconductor drum 11Y by the drum cleaner 17Y and magenta waste toner removed from the photoconductor drum 11M by the drum cleaner 17M are collected with the first collection container 72A. In other words, in the collecting unit 70, the first collection container 72A collects waste toner of any two of the ordinary colors (yellow, magenta, and cyan) other than black.

On the other hand, in the collecting unit 70, the second collection container 72B collects cyan waste toner removed from the photoconductor drum 11C by the drum cleaner 17C, in addition to black waste toner removed from the photoconductor drum 11K by the drum cleaner 17K and spot-color waste toner removed from the photoconductor drum 11P by the drum cleaner 17P. In other words, in the collecting unit 70, the second collection container 72B collects waste toner of one of ordinary colors (yellow, magenta, and cyan) other than black.

Specifically, in the collecting unit 70 according to the present exemplary embodiment, the number of ordinary-color toner other than black toner collected with the second collection container 72B is smaller than the number of ordinary-color toner other than black toner collected with the first collection container 72A.

Thus, even when collecting black waste toner and ordinary-color waste toner other than black are collected with the same collection container (second collection container 72B), in the collecting unit 70, the second collection container 72B is prevented from collecting an extremely large amount of waste toner, compared to the case where the second collection container 72B collects toner of ordinary colors other than black, the number of which is larger than or equal to the number of ordinary colors other than black collected with the first collection container 72A.

Third Exemplary Embodiment

Subsequently, a third exemplary embodiment of the present disclosure will be described. Components the same as those of the first exemplary embodiment are denoted with the same reference signs without being described in detail.

Figure 4:
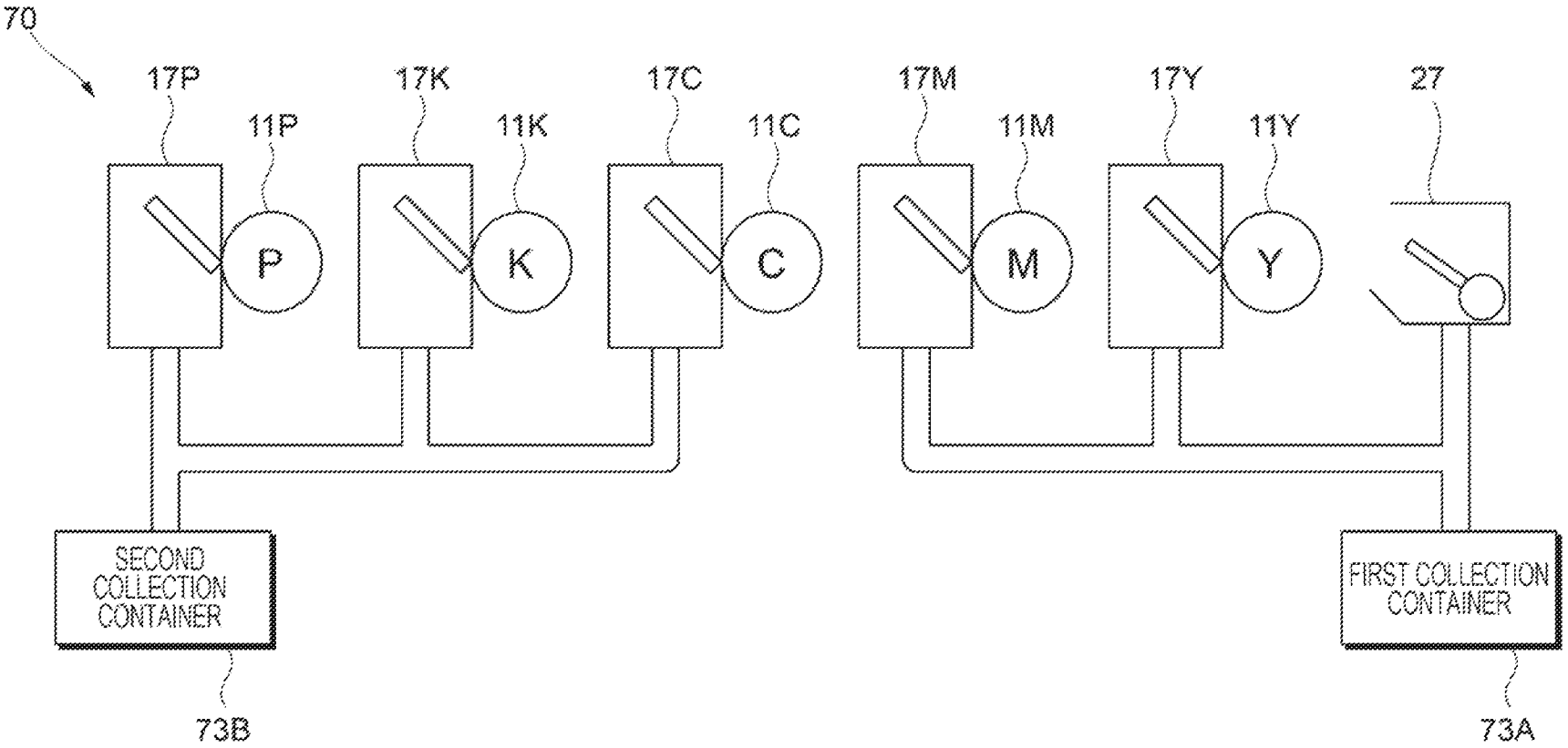
FIG. 4 illustrates a structure of a collecting unit according to a third exemplary embodiment.

FIG. 4 illustrates a structure of a collecting unit 70 according to a third exemplary embodiment.

The collecting unit 70 according to the present exemplary embodiment includes a first collection container 73A and a second collection container 73B, each of which collects waste toner. Here, the first collection container 73A is an example of a second collecting unit, and the second collection container 73B is an example of a first collecting unit.

As illustrated in FIG. 4, in the collecting unit 70 according to the present exemplary embodiment, the first collection container 73A collects waste toner removed from the surface of the photoconductor drum 11Y by the drum cleaner 17Y, waste toner removed from the surface of the photoconductor drum 11M by the drum cleaner 17M, and waste toner removed from the surface of the intermediate transfer belt 15 by the belt cleaner 27.

The second collection container 73B collects waste toner removed from the surface of the photoconductor drum 11K by the drum cleaner 17K, waste toner removed from the surface of the photoconductor drum 11P by the drum cleaner 17P, and waste toner removed from the surface of the photoconductor drum 11C by the drum cleaner 17C.

In the collecting unit 70 according to the present exemplary embodiment, as in the case of the first exemplary embodiment, a large amount of black waste toner removed from the photoconductor drum 11K by the drum cleaner 17K and a small amount of spot-color waste toner removed from the photoconductor drum 11P by the drum cleaner 17P are collected with the same collection container (second collection container 73B). Thus, compared to the case where, for example, black waste toner is collected with the first collection container 73A, different from a collection container that collects spot-color waste toner, this structure prevents a collection container that collects black waste toner from collecting an extremely larger amount of waste toner than other collection containers, or a collection container that collects spot-color waste toner from collecting an extremely smaller amount of waste toner than other collection containers. Thus, the difference between the amount of waste toner collected with the first collection container 73A and the amount of waste toner collected with the second collection container 73B is reduced.

In the collecting unit 70 according to the present exemplary embodiment, waste toner removed from the intermediate transfer belt 15 (refer to FIG. 1) by the belt cleaner 27 is collected with the first second collection container 73A. Thus, compared to the case, for example, where waste toner removed from the intermediate transfer belt 15 by the belt cleaner 27 is collected with a collection container other than the first collection container 73A and the second collection container 73B, the number of collection containers included in the collecting unit 70 is reduced.

Fourth Exemplary Embodiment

Subsequently, a fourth exemplary embodiment of the present disclosure will be described. Components the same as those of the first exemplary embodiment are denoted with the same reference signs without being described in detail.

Figure 5:
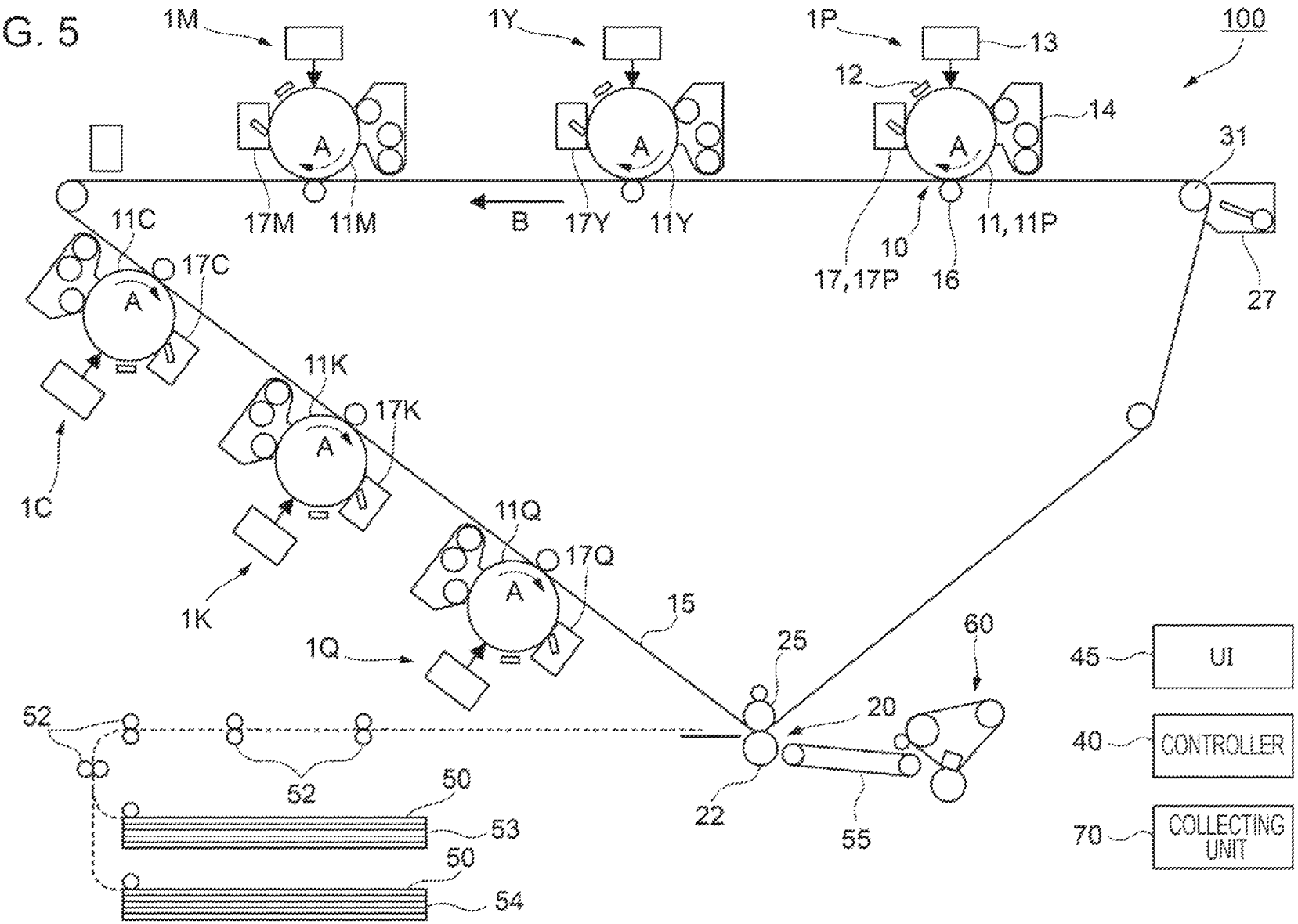
FIG. 5 is a schematic diagram of a structure of an image forming apparatus according to a fourth exemplary embodiment.

FIG. 5 is a schematic diagram of a structure of an image forming apparatus 100 according to a fourth exemplary embodiment.

The image forming apparatus 100 includes image forming units 1Y, 1M, 1C, and 1K, which respectively form images of yellow (Y), magenta (M), cyan (C), and black (K). The image forming apparatus 100 also includes an image forming unit 1P, which forms images of a first spot color, and an image forming unit 1Q, which forms images of a second spot color different from the first spot color.

As in the case of the first exemplary embodiment, each of the image forming units 1Y, 1M, 1C, 1K, 1P, and 1Q includes a photoconductor drum 11, a charging device 12, a laser exposure device 13, a developing device 14, a first transfer roller 16, and a drum cleaner 17. In the following description, the photoconductor drums 11 included in the image forming units 1Y, 1M, 1C, 1K, 1P, and 1Q may be referred to as photoconductor drums 11Y, 11M, 11C, 11K, 11P, and 11Q, and the drum cleaners 17 included in the image forming units 1Y, 1M, 1C, 1K, 1P, and 1Q may be referred to as drum cleaners 17Y, 17M, 17C, 17K, 17P, and 17Q.

Figure 6:
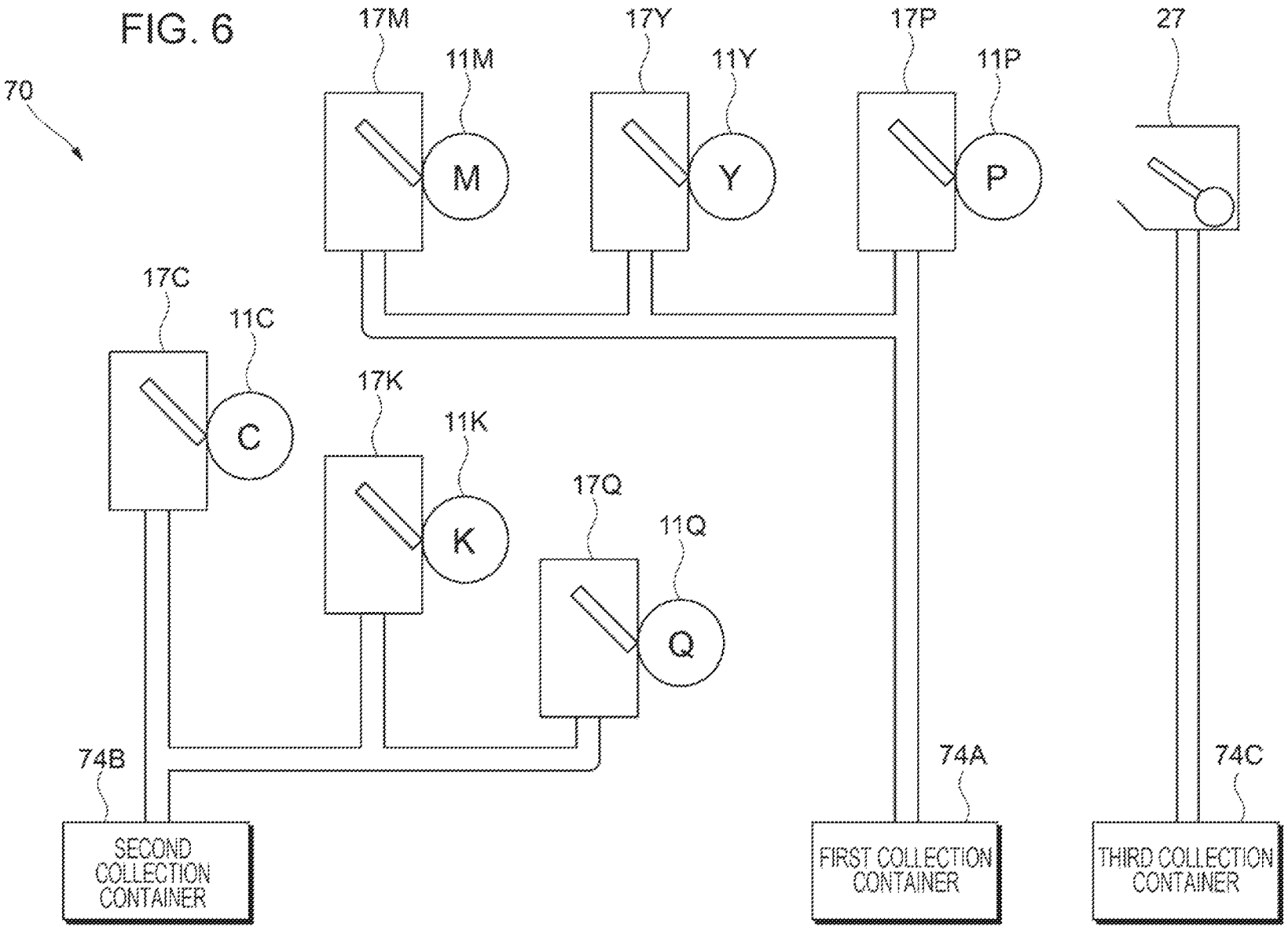
FIG. 6 illustrates a structure of a collecting unit according to a fourth exemplary embodiment.

Subsequently, the collecting unit 70 according to the present exemplary embodiment will be described. FIG. 6 illustrates a structure of the collecting unit 70 according to the fourth exemplary embodiment.

The collecting unit 70 according to the present exemplary embodiment includes a first collection container 74A, a second collection container 74B, and a third collection container 74C, each of which collects waste toner. Here, the first collection container 74A is an example of a second collecting unit, the second collection container 74B is an example of a first collecting unit, and the third collection container 74C is an example of a third collecting unit.

As illustrated in FIG. 6, in the collecting unit 70 according to the present exemplary embodiment, the first collection container 74A collects first-spot-color waste toner removed from the surface of the photoconductor drum 11P by the drum cleaner 17P, yellow waste toner removed from the surface of the photoconductor drum 11Y by the drum cleaner 17Y, and magenta waste toner removed from the surface of the photoconductor drum 11M by the drum cleaner 17M.

The second collection container 74B collects cyan waste toner removed from the surface of the photoconductor drum 11C by the drum cleaner 17C, black waste toner removed from the surface of the photoconductor drum 11K by the drum cleaner 17K, and second-spot-color waste toner removed from the surface of the photoconductor drum 11Q by the drum cleaner 17Q.

The third collection container 74C collects waste toner removed from the intermediate transfer belt 15 (refer to FIG. 5) by the belt cleaner 27.

In the collecting unit 70 according to the present exemplary embodiment, a large amount of black waste toner removed from the photoconductor drum 11K by the drum cleaner 17K and a small amount of second-spot-color waste toner removed from the photoconductor drum 11Q by the drum cleaner 17Q, which is one of two types of spot-color waste toner, are collected with the same collection container (second collection container 74B). Compared to the case, for example, where black waste toner and two types of spot-color waste toner are collected with different collection containers, this structure prevents a collection container that collects two types of spot-color waste toner from collecting an extremely smaller amount of waste toner than other collection containers. Thus, the difference between the amount of waste toner collected with the first collection container 74A and the amount of waste toner collected with the second collection container 74B is reduced.

In the collecting unit 70 according to the present exemplary embodiment, the first-spot-color waste toner removed from the photoconductor drum 11P by the drum cleaner 17P is collected with the first collection container 74A, and the second-spot-color waste toner removed from the photoconductor drum 11Q by the drum cleaner 17Q is collected with the second collection container 74B. More specifically, in the collecting unit 70 according to the present exemplary embodiment, two types of spot-color waste toner are collected with different collection containers. Thus, compared to the case, for example, where two types of spot-color waste toner are collected with the same collection container, the difference between the amount of waste toner collected with the first collection container 74A and the amount of waste toner collected with the second collection container 74B is reduced.

In the collecting unit 70 according to the present exemplary embodiment, the first collection container 74A collects first-spot-color, yellow, and magenta waste toner, and the second collection container 74B collects cyan, black, and second-spot-color waste toner. Specifically, the first collection container 74A and the second collection container 74B collect waste toner of the same number of colors. Thus, compared to the case, for example, where the first collection container 74A and the second collection container 74B collect waste toner of different number of colors, this structure reduces the difference between the amount of waste toner collected with the first collection container 74A and the amount of waste toner collected with the second collection container 74B.

In the collecting unit 70 according to the present exemplary embodiment, as in the case of the first exemplary embodiment, waste toner removed from the intermediate transfer belt 15 (refer to FIG. 5) by the belt cleaner 27 is collected with the third collection container 74C, different from the second collection container 74B that collects black waste toner removed from the photoconductor drum 11K by the drum cleaner 17K. Thus, compared to the case, for example, where waste toner removed from the intermediate transfer belt 15 by the belt cleaner 27 is collected with the second collection container 74B, which also collects black waste toner, this structure prevents an excess of the amount of waste toner collected with the second collection container 74B.

In the present exemplary embodiment, the image forming units 1P, 1Y, and 1M are disposed at substantially the same level in the vertical direction, and the image forming units 1C, 1K, and 1Q are disposed below the image forming units 1P, 1Y, and 1M in the vertical direction.

In the collecting unit 70, the first collection container 74A collects first-spot-color, yellow, and magenta waste toner, and the second collection container 74B collects cyan, black, and second-spot-color waste toner. Specifically, the collecting unit 70 includes the first collection container 74A that collects waste toner of colors corresponding to the image forming units disposed above in the vertical direction, and the second collection container 74B that collects waste toner of colors corresponding to the image forming units disposed below in the vertical direction. Thus, a waste toner collection path in the collecting unit 70 is divided into a vertically upper path and a vertically lower path to easily guide waste toner to the respective collection containers.

Fifth Exemplary Embodiment

Subsequently, a fifth exemplary embodiment of the present disclosure will be described. Components the same as those of the first and fourth exemplary embodiments are denoted with the same reference signs without being described in detail.

Figure 7:
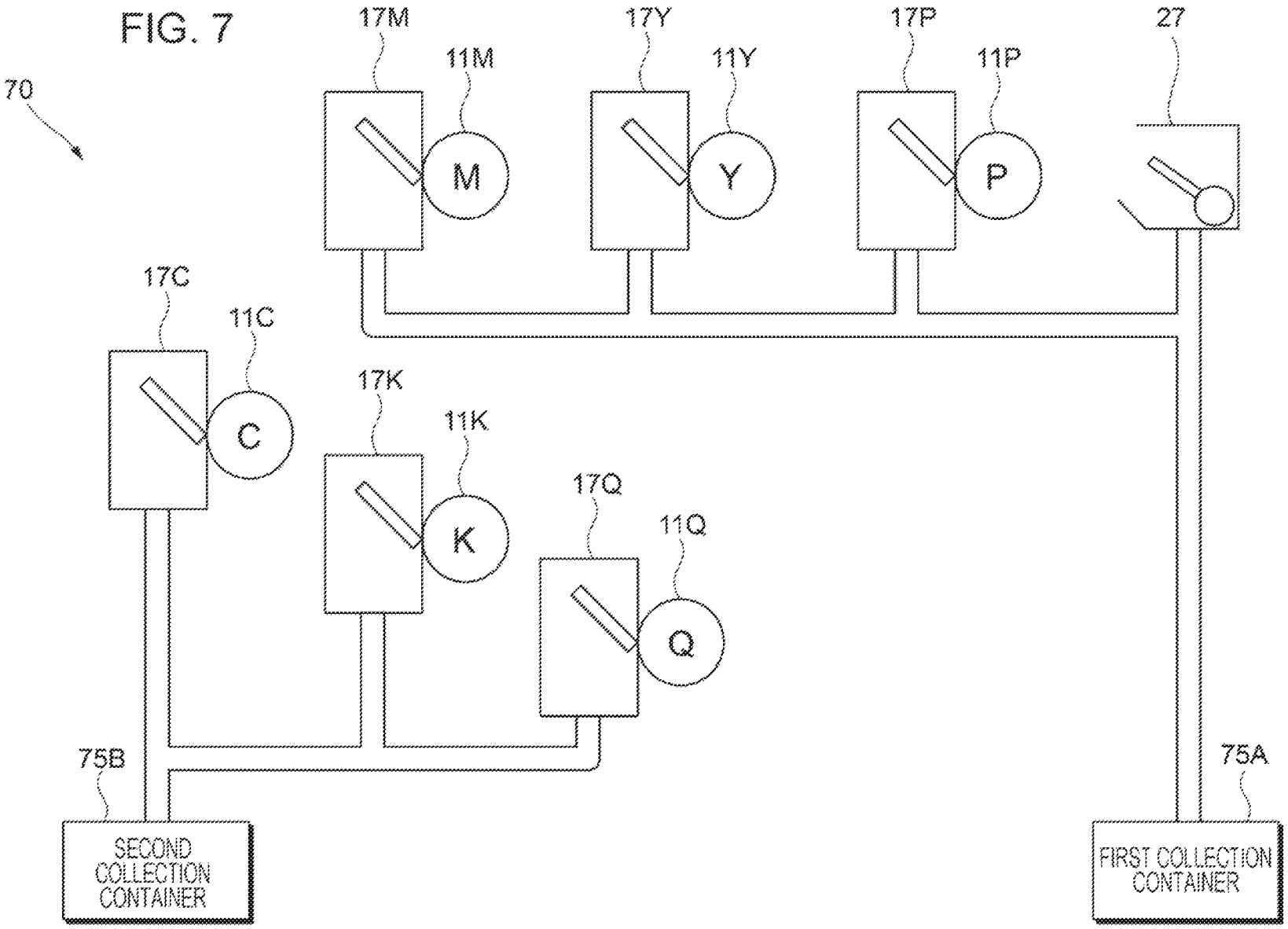
FIG. 7 illustrates a structure of a collecting unit according to a fifth exemplary embodiment.

FIG. 7 illustrates a structure of a collecting unit 70 according to a fifth exemplary embodiment.

The collecting unit 70 according to the present exemplary embodiment includes a first collection container 75A and a second collection container 75B, each of which collects waste toner. The first collection container 75A is an example of a second collecting unit or a third collecting unit. The second collection container 75B is an example of a first collecting unit.

As illustrated in FIG. 7, in the collecting unit 70 according to the present exemplary embodiment, the first collection container 75A collects first-spot-color waste toner removed from the surface of the photoconductor drum 11P by the drum cleaner 17P, yellow waste toner removed from the surface of the photoconductor drum 11Y by the drum cleaner 17Y, magenta waste toner removed from the surface of the photoconductor drum 11M by the drum cleaner 17M, and waste toner removed from the intermediate transfer belt 15 (refer to FIG. 5) by the belt cleaner 27.

The second collection container 75B collects cyan waste toner removed from the surface of the photoconductor drum 11C by the drum cleaner 17C, black waste toner removed from the surface of the photoconductor drum 11K by the drum cleaner 17K, and second-spot-color waste toner removed from the surface of the photoconductor drum 11Q by the drum cleaner 17Q.

In the collecting unit 70 according to the present exemplary embodiment, as in the case of the fourth exemplary embodiment, a large amount of black waste toner removed from the photoconductor drum 11K by the drum cleaner 17K and a small amount of second-spot-color waste toner removed from the photoconductor drum 11Q by the drum cleaner 17Q, which is one of two types of spot-color waste toner, are collected with the same collection container (second collection container 75B). Compared to the case, for example, where black waste toner and two types of spot-color waste toner are collected with different collection containers, this structure prevents a collection container that collects two types of spot-color waste toner from collecting an extremely smaller amount of waste toner than other collection containers. Thus, the difference between the amount of waste toner collected with the first collection container 75A and the amount of waste toner collected with the second collection container 75B is reduced.

In the collecting unit 70 according to the present exemplary embodiment, as in the case of the fourth exemplary embodiment, first-spot-color waste toner removed from the photoconductor drum 11P by the drum cleaner 17P is collected with the first collection container 75A, and second-spot-color waste toner removed from the photoconductor drum 11Q by the drum cleaner 17Q is collected with the second collection container 75B. More specifically, in the collecting unit 70 according to the present exemplary embodiment, two types of spot-color waste toner are collected with different collection containers. Thus, compared to the case, for example, where two types of spot-color waste toner are collected with the same collection container, the difference between the amount of waste toner collected with the first collection container 75A and the amount of waste toner collected with the second collection container 75B is reduced.

In the collecting unit 70 according to the present exemplary embodiment, the first collection container 75A collects first-spot-color, yellow, and magenta waste toner, and the second collection container 75B collects cyan, black, and second-spot-color waste toner. Specifically, the first collection container 75A and the second collection container 75B collect waste toner of the same number of colors. Compared to the case, for example, where the first collection container 75A and the second collection container 75B collect waste toner of different numbers of colors, this structure reduces the difference between the amount of waste toner collected with the first collection container 75A and the amount of waste toner collected with the second collection container 75B.

In the collecting unit 70 according to the present exemplary embodiment, a large amount of waste toner removed from the intermediate transfer belt 15 by the belt cleaner 27 is collected with the first collection container 75A, different from the second collection container 75B that collects a large amount of black waste toner removed from the photoconductor drum 11K by the drum cleaner 17K. Thus, compared to the case, for example, where waste toner removed from the intermediate transfer belt 15 by the belt cleaner 27 is collected with the collection container (for example, the second collection container 75B) that also collects black waste toner, the collection container that collects black waste toner is prevented from collecting an extremely larger amount of waste toner than other collection containers.

Compared to the case where waste toner removed from the intermediate transfer belt 15 by the belt cleaner 27 is collected with a collection container other than the first collection container 75A and the second collection container 75B, the number of collection containers included in the collecting unit 70 is reduced.

In the present exemplary embodiment, the image forming units 1P, 1Y, and 1M are disposed at substantially the same level in the vertical direction, and the image forming units 1C, 1K, and 1Q are disposed below the image forming units 1P, 1Y, and 1M in the vertical direction. The belt cleaner 27 is disposed at the level closer to the image forming units 1P, 1Y, and 1M in the vertical direction than the image forming units 1C.

In the collecting unit 70, the first collection container 75A collects first-spot-color, yellow, and magenta waste toner, and waste toner removed from the belt cleaner 27, and the second collection container 75B collects cyan, black, and second-spot-color waste toner. Specifically, the collecting unit 70 includes the first collection container 75A, which collects waste toner from the belt cleaner 27 and the image forming units disposed on the upper side in the vertical direction, and the second collection container 75B, which collects waste toner of colors corresponding to the image forming units disposed on the lower side in the vertical direction. Thus, the waste toner collection path in the collecting unit 70 is divided into a vertically upper path and a vertically lower path to easily guide waste toner to the respective collection containers.

Thus far, the first to fifth exemplary embodiments of the present disclosure have been described. However, the disclosure is not limited to the above exemplary embodiments, and may be changed as appropriate within the range not impairing the gist of the disclosure.

For example, the image forming apparatus 100 including the intermediate transfer belt 15 has been described above. However, the image forming apparatus 100 may be a so-called direct-transfer image forming apparatus that directly transfers images formed on the photoconductor drums 11 to a sheet 50. In this case, waste toner removed from the photoconductor drums 11 may be collected in the same manner as described in the first to fifth exemplary embodiments.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus, comprising:

a black image carrier configured to hold black toner images;

a yellow image carrier configured to hold yellow toner images;

a magenta image carrier configured to hold magenta toner images;

a cyan image carrier configured to hold cyan toner images;

at least one spot-color image carrier configured to hold toner images of a spot color other than black, yellow, magenta, and cyan; and a plurality of collecting units each of which is configured to collect waste toner, the plurality of collecting units including a first collecting unit configured to collect waste toner removed from the black image carrier and waste toner removed from the spot-color image carrier.

2. The image forming apparatus according to claim 1, wherein the plurality of collecting units include a second collecting unit configured to collects waste toner removed from at least one of the yellow image carrier, the magenta image carrier, and the cyan image carrier.

3. The image forming apparatus according to claim 2, wherein among the plurality of collecting units, the second collecting unit is configured to collect waste toner removed from any two of the yellow image carrier, the magenta image carrier, and the cyan image carrier, and a number of colors of waste toner that the first collecting unit is configured to collect and a number of colors of waste toner that the second collecting unit is configured to collect are equal to each other.

4. The image forming apparatus according to claim 2, wherein the at least one spot-color image carrier includes a plurality of spot-color image carriers configured to hold toner images of different spot colors, and wherein, among the plurality of collecting units, the first collecting unit is configured to collect waste toner removed from a first one of the plurality of spot-color image carriers, and the second collecting unit is configured to collect waste toner removed from a second one of the spot-color image carriers different from the first spot-color image carrier.

5. The image forming apparatus according to claim 3, wherein the at least one spot-color image carrier includes a plurality of spot-color image carriers configured to hold toner images of different spot colors, and wherein, among the plurality of collecting units, the first collecting unit is configured to collect waste toner removed from a first one of the plurality of spot-color image carriers, and the second collecting unit is configured to collect waste toner removed from a second one of the spot-color image carriers different from the first spot-color image carrier.

6. The image forming apparatus according to claim 4, wherein among the plurality of collecting units, the first collecting unit is configured to collect waste toner removed from one of the yellow image carrier, the magenta image carrier, and the cyan image carrier, waste toner removed from the black image carrier, and waste toner removed from the first spot-color image carrier, and the second collecting unit is configured to collect waste toner removed from two of the yellow image carrier, the magenta image carrier, and the cyan image carrier left without being collected by the first collecting unit, and waste toner removed from the second spot-color image carrier.

7. The image forming apparatus according to claim 5, wherein among the plurality of collecting units, the first collecting unit is configured to collect waste toner removed from one of the yellow image carrier, the magenta image carrier, and the cyan image carrier, waste toner removed from the black image carrier, and waste toner removed from the first spot-color image carrier, and the second collecting unit is configured to collect waste toner removed from two of the yellow image carrier, the magenta image carrier, and the cyan image carrier left without being collected by the first collecting unit, and waste toner removed from the second spot-color image carrier.

8. The image forming apparatus according to claim 1, further comprising:

a transfer body configured to transfer images formed on the black image carrier, the yellow image carrier, the magenta image carrier, the cyan image carrier, and the spot-color image carrier, wherein the plurality of collecting units include a third collecting unit configured to collect waste toner removed from the transfer body, the third collecting unit being different from the first collecting unit.

9. The image forming apparatus according to claim 8, wherein among the plurality of collecting units, the third collecting unit is configured to collect waste toner removed from the yellow image carrier, the magenta image carrier, and the cyan image carrier, and waste toner removed from the transfer body.

10. The image forming apparatus according to claim 1, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

11. The image forming apparatus according to claim 2, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

12. The image forming apparatus according to claim 3, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

13. The image forming apparatus according to claim 4, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

14. The image forming apparatus according to claim 5, wherein the image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

15. The image forming apparatus according to claim 6, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

16. The image forming apparatus according to claim 7, wherein image carriers, from which waste toner collected by the first collecting unit is removed, are wherein image carriers, from which waste toner collected by one or more of the collecting units other than the first collecting unit is removed, are second image carriers, and wherein the first image carriers are disposed below the second image carriers.

17. The image forming apparatus according to claim 8, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

18. The image forming apparatus according to claim 9, wherein image carriers, from which waste toner collected by the first collecting unit is removed, are first image carriers, wherein image carriers, from which waste toner collected by one or more of the collecting units other than the first collecting unit is removed, are second image carriers, and wherein the first image carriers are disposed below the second image carriers.

19. An image forming apparatus, comprising:

a black image carrier configured to hold black toner images;

a yellow image carrier configured to hold yellow toner images;

a magenta image carrier configured to hold magenta toner images;

a cyan image carrier configured to hold cyan toner images;

a transfer body configured to transfer the toner images formed on the black image carrier, the yellow image carrier, the magenta image carrier, and the cyan image carrier, a first collecting unit configured to collect waste toner removed from the black image carrier; and a second collecting unit configured to collect waste toner removed from at least one of the yellow image carrier, the magenta image carrier, and the cyan image carrier, wherein the second collecting unit is configured to collect waste toner removed from the transfer body.

20. A collecting device, comprising:

a first collecting unit configured to collect waste toner removed from a black image carrier configured to hold black toner images, wherein the first collecting unit is configured to collect waste toner removed from a spot-color image carrier configured to hold toner images of a spot color other than black, yellow, magenta, and cyan; and a second collecting unit configured to collect waste toner removed from at least one of a yellow image carrier configured to hold yellow toner images, a magenta image carrier configured to hold magenta toner images, and a cyan image carrier configured to hold cyan toner images.

21. The image forming apparatus according to claim 1, wherein the first collecting unit is configured to collect waste toner removed from both of the black image carrier and the spot-color image carrier with a same part of the first collecting unit.

22. The image forming apparatus according to claim 1, wherein the first collecting unit comprises a container configured to collect waste toner removed from both of the black image carrier and the spot-color image carrier.

* * * * *